US008539883B2

(12) United States Patent
Reckefuss et al.

(10) Patent No.: US 8,539,883 B2
(45) Date of Patent: Sep. 24, 2013

(54) METHOD AND APPARATUS FOR REGULATING THE REGISTER IN A PRINTING PRESS

(75) Inventors: Klaus Reckefuss, Leopoldshoehe (DE); Gerhard Lohmeyer, Preussisch Oldendorf (DE); Bernd Morgenstern, Leipzig (DE)

(73) Assignee: Eltromat GmbH (DE)

( * ) Notice: Subject to any disclaimer, the term of this patent is extended or adjusted under 35 U.S.C. 154(b) by 509 days.

(21) Appl. No.: 12/626,193

(22) Filed: Nov. 25, 2009

(65) Prior Publication Data

US 2010/0139512 A1 Jun. 10, 2010

(30) Foreign Application Priority Data

Nov. 28, 2008 (DE) ..... 10 2008 059 584

(51) Int. Cl.

| | |
|---|---|
| ***B41F 33/00*** | (2006.01) |
| ***B41F 3/08*** | (2006.01) |
| ***B41F 21/12*** | (2006.01) |
| ***B41F 1/54*** | (2006.01) |
| ***B41F 1/66*** | (2006.01) |
| ***B41L 1/02*** | (2006.01) |
| ***B41L 3/02*** | (2006.01) |
| ***B41L 5/12*** | (2006.01) |
| ***B41L 39/00*** | (2006.01) |
| ***B41L 47/56*** | (2006.01) |

(52) U.S. Cl.

USPC ..... 101/486; 101/484; 101/481

(58) Field of Classification Search

USPC ..... 101/481, 486, 484, DIG. 46

See application file for complete search history.

(56) References Cited

U.S. PATENT DOCUMENTS

| | | | | |
|---|---|---|---|---|
| 6,108,436 | A * | 8/2000 | Jansen et al. | 382/112 |
| 6,591,746 | B2 * | 7/2003 | Siler | 101/171 |
| 7,013,803 | B2 * | 3/2006 | Hansen et al. | 101/181 |
| 7,665,400 | B2 * | 2/2010 | Duke | 101/481 |
| 2005/0284316 | A1 * | 12/2005 | Rugamer | 101/216 |
| 2009/0020029 | A1 * | 1/2009 | Reckefuss | 101/248 |
| 2009/0038491 | A1 * | 2/2009 | Rugamer | 101/219 |
| 2009/0041296 | A1 * | 2/2009 | Dirsch et al. | 382/100 |
| 2009/0141294 | A1 * | 6/2009 | Dirsch et al. | 358/1.9 |
| 2009/0211473 | A1 * | 8/2009 | Peters et al. | 101/170 |

FOREIGN PATENT DOCUMENTS

| | | | |
|---|---|---|---|
| DE | 102006009434 | A1 * | 3/2006 |
| DE | 102005019566 | A1 | 11/2006 |
| EP | 0637286 | B1 | 1/1994 |
| EP | 1619062 | A2 * | 1/2006 |
| EP | 2191970 | A2 | 6/2010 |
| EP | 2191970 | A3 | 9/2011 |
| WO | 2004028805 | A1 | 4/2004 |

* cited by examiner

*Primary Examiner* — Judy Nguyen
*Assistant Examiner* — Leo T Hinze
(74) *Attorney, Agent, or Firm* — Howard & Howard Attorneys PLLC

(57) ABSTRACT

The invention relates to a method and an apparatus for regulating the register of a rotary printing press (18), including a register regulator (17), the components (1, 5; 2, 6; 3, 7; 4, 8; 9, 10) of which are connected in a real-time bus system (12) and are chronologically synchronized therein.

15 Claims, 4 Drawing Sheets

1 - ID field (example with three parts)
2 .... N prinded marks

METHOD AND APPARATUS FOR REGULATING THE REGISTER IN A PRINTING PRESS

BACKGROUND OF THE INVENTION

1. Field of the Invention

The invention relates to a method and an apparatus for regulating the register in a printing press.

2. Description of the Related Art

In case of multi-color printing with rotary printing presses, the colors have to be printed in the respective printing units on top of each other in accordance with register marks. If this is not possible, a dowdy and thus unsellable print is obtained, which means that a loss of material results. During the continuous printing operation, deviations from the register marks may occur due to various reasons. These deviations have to be compensated for in order to obtain a sufficient printing quality. Such deviations of register marks are usually measured by means of a register control device and re-controlled automatically.

A reel fed printing press of the above-mentioned type comprises at least two printing units, wherein each of these comprises at least one cylinder including the printing plate on its surface and a second cylinder, between which the object to be printed, generally a web or a sheet, is passed for being printed.

For this purpose, each printing unit usually co-prints at least one mark. The respective position of this mark is measured relative to a mark printed by another printing unit or another position information from the printing press, e.g. the rotating angle information of one of the aforementioned cylinders. A register correction signal is generated based on the deviation of a target position representing a good printout. This signal is then performed by suitable devices (e.g. register rollers) and thus generates again a printout in accordance with the register marks. Such register control devices are generally known in the related art as evidenced, for example, by EP 0 637 286 B1.

DE 10 2005 019 566 A1 describes a register control device for a gravure printing machine having the typical components, including, for example, one driving unit and one data logging device in each printing unit as illustrated in FIG. 1.

DE 10 2005 054 975 describes a controller system for the register in a printing machine that includes at least one printing unit. The controller system includes at least one register control device, in which a pilot control variable and an register error estimated variable are used for influencing the register. Further, this application teaches that the printing machine has only one single data bus for transmitting the register error estimated variable and the pilot control variable as well as for transmitting rotations speeds and positions for the speed control.

In addition, DE 10 2005 054 975 provides that the estimated error variables, which are the variables to be performed in the individual drives for a register correction, shall be transmitted via a bus. However, the measured register deviation variables are not transmitted despite the fact that the processing of the register deviation variables is nevertheless of equal relevance for a control.

It has proven to be disadvantageous in both aforementioned devices and methods that the data logging devices are directly included into the drive unit, and therewith the measured values for the register positions and register deviations are only generated and present at the printing unit where they are sensed. Consequently, a controller having a decentralized regulating concept is obtained, which may be rather disadvantageous in a variety of applications.

Any additional effort in view of wiring and signal processing, as is required, for example, in the solution of the first-mentioned document, is generally disadvantageous. An avoidance of this disadvantage by using the usual data bus and operating systems is purposeful only to a limited extent, since such systems—despite generally high transmission rates—feature a relative temporal imprecision when exchanging information. Thus, the cycle time of a control cycle is unfortunately limited toward a lower limit and the precision of determining a position is decreased. The use of a driving bus for transmitting correction values, as it is proposed in DE 10 2005 054 975, solves the last-mentioned problem only partially.

SUMMARY OF THE INVENTION

The present invention overcomes disadvantages in the related art in a method for controlling the register in a rotary printing press by a register control device. The printing press typically includes at least one printing unit each of which includes at least one cylinder supporting a printing image to be transmitted and at least one cylinder pressing the printing fabric against the other cylinder. The control device includes at least a measuring unit and a measuring head. The control device also includes a register control unit, a trigger unit, and a drive unit wherein these components of the control device are mutually connected through a real-time bus system in which all bus members are chronologically synchronized with each other. The method of the present invention includes the steps of, for each trigger unit and/or measuring unit and/register control unit, a reference table is generated and transmitted via the bus system, which refers to a time reference common to all components, which is generated by the bus system. A time interval limited by at least two reference dates issued chronologically in succession is further divided by the trigger unit by issuing at least one time signal located between the reference dates. The trigger unit selects one signal from the signal sequence generated in the preceding step for triggering a measuring step to be performed by the measuring head. The measuring head detects a printed pattern which is part of the printed printout. In the measuring unit, position information concerning the printout respectively transmitted by the printing unit is determined based on the pattern scanned by the measuring head. In the register control unit, correction values are calculated based on the position information determined by one or more measuring unit(s) as well as on information transmitted from other sources. The correction values are transmitted to the drive units and performed therein.

In addition, the present invention is also directed toward the register regulating apparatus, per se. This apparatus includes at least one measuring unit, at least one measuring head, at least one register control unit, at least one trigger unit, at least one drive unit or one drive controller, and a real-time bus system. The real-time bus system connects the measuring unit, the measuring head, the register control unit, the trigger unit, and the drive unit. These bus members are chronologically synchronized with each other.

Other objects, features and advantages of the present invention will be readily appreciated as the same becomes better understood after reading the subsequent description taken in connection with the accompanying drawings.

DETAILED DESCRIPTION OF THE INVENTION

Figure 1:
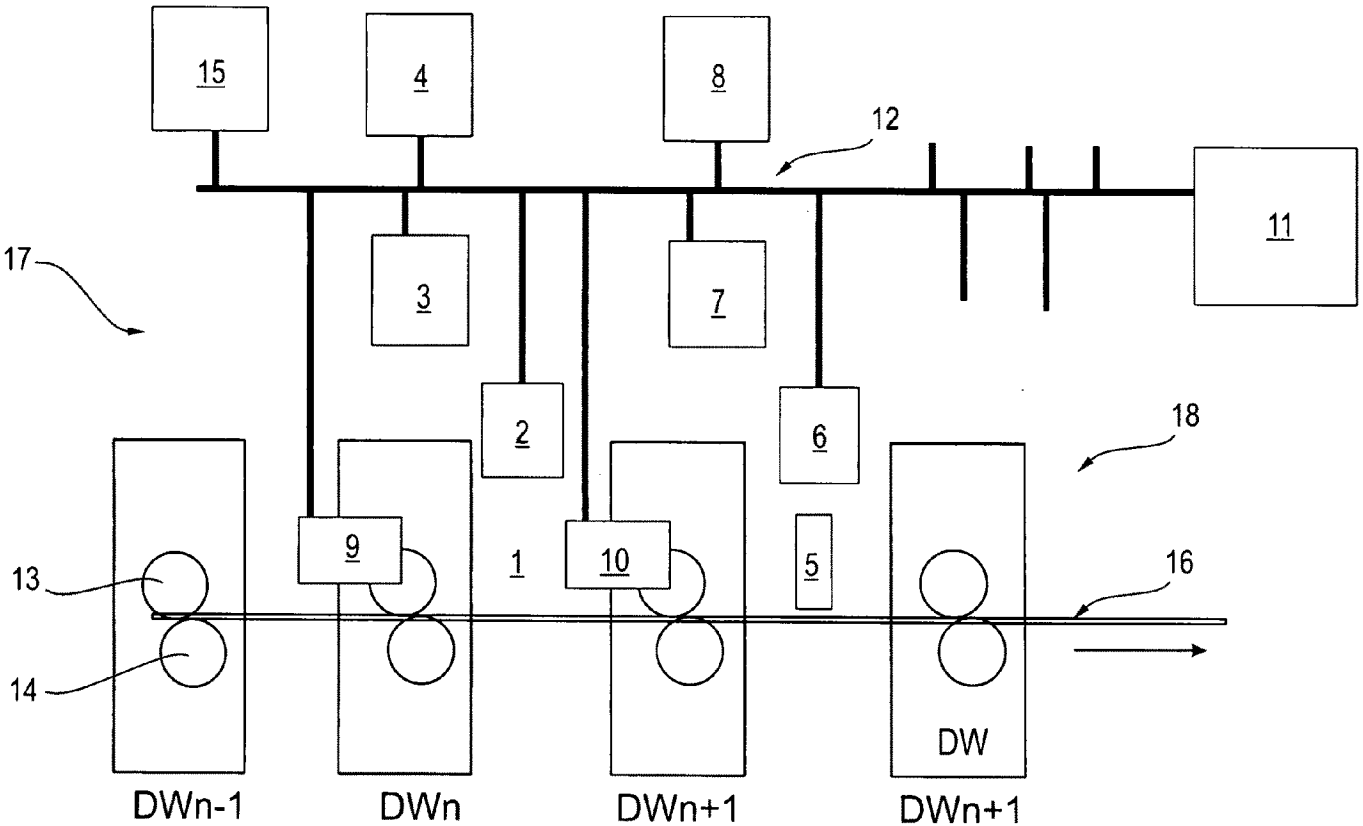
FIG. 1 is a schematic block diagram illustrating the structure of the control device according to the invention.

According to the invention and FIG. 1, a real-time bus system 12 is used for a signal transmission for the measured values and for an exactly determined retrieval of the measuring signals. In one embodiment, all events on the bus system 12 are permanently synchronized by a common clock (e.g. in accordance with specification of IEE1588). According to FIG. 1, an inventive register control (regulating) device 17 for a printing press 18 includes at least one register control unit 3, 7, a trigger unit 4, 8 effecting the generation and processing of synchronizing information and a measuring unit 2, 6 including a measuring head 1, 5, in addition to the drive regulating means for the electric machine as a member of such a bus system 12 and in addition to other possible bus members. The formation of all units as members on one and the same real-time bus system 12 also enables that a single trigger unit can be assigned to several measuring units and/or controller units. A variation thereof may include, for example, that the trigger unit is integrated into a measuring unit. A fixed assignment of one specific measuring unit to one specific register control unit no longer exists. Rather, each register control unit is configured to read and process the information required for its assigned function from all data available. Similarly, data obtained by a plurality of measuring units can be considered by a register control unit for calculating a register correction value.

One embodiment for detecting register deviations utilizes the measuring of a position of marks which are printed, during the printing process, at least by one printing unit periodically, generally per printing format, onto the material web. Such an embodiment shall herein be considered as an example, although any characteristic and therewith technically identifiable image information may be used in other embodiments instead of the mark described herein.

Based on the data detected by the measuring unit, the position of the mark is either determined relative to the position of a mark printed by an other printing unit, or the determined position of at least one printed mark is compared to a position information directly associated with the rotational angle position of a printing cylinder (or a cylinder supporting the printed image). From these data, a position information of the printed mark is calculated. Both methods are referred to as either web-web-method or web-cylinder-method.

For the measuring, the marks must be printed within a relatively small detection window in the circumferential direction. Within this window, the measuring is performed. Such a measuring is normally performed optically by means of an optical reflection scanning. In this event, the position of the printed marks in longitudinal and lateral directions is determined from an image or a chronological sequence of the light emission when passing a measuring head sensing points. This is obtained, for example, by using an edge detection method of the type known in the related art.

The method of the present invention includes position information of individual printing cylinders (in FIG. 1: cylinder 13, 14 representative for all cylinders) and/or a superordinate other rotational angle information source (e.g. a virtual guide axis 11) including very precise, definedly spaced, associated time information as reference data (e.g. so-called time stamps or alternatively also bus cycles) are transmitted on the real-time bus system 12 (e.g. in accordance with IEE 1588) for this purpose. A position information transmitted in this way is then used by a trigger unit 4 or 8 to calculate the start time of a measuring step and to supply same to one or more sensor(s) for triggering a predetermined function, for example, triggering a measuring step. Position information may be transmitted via the bus system also several times per printing format.

Figure 2:
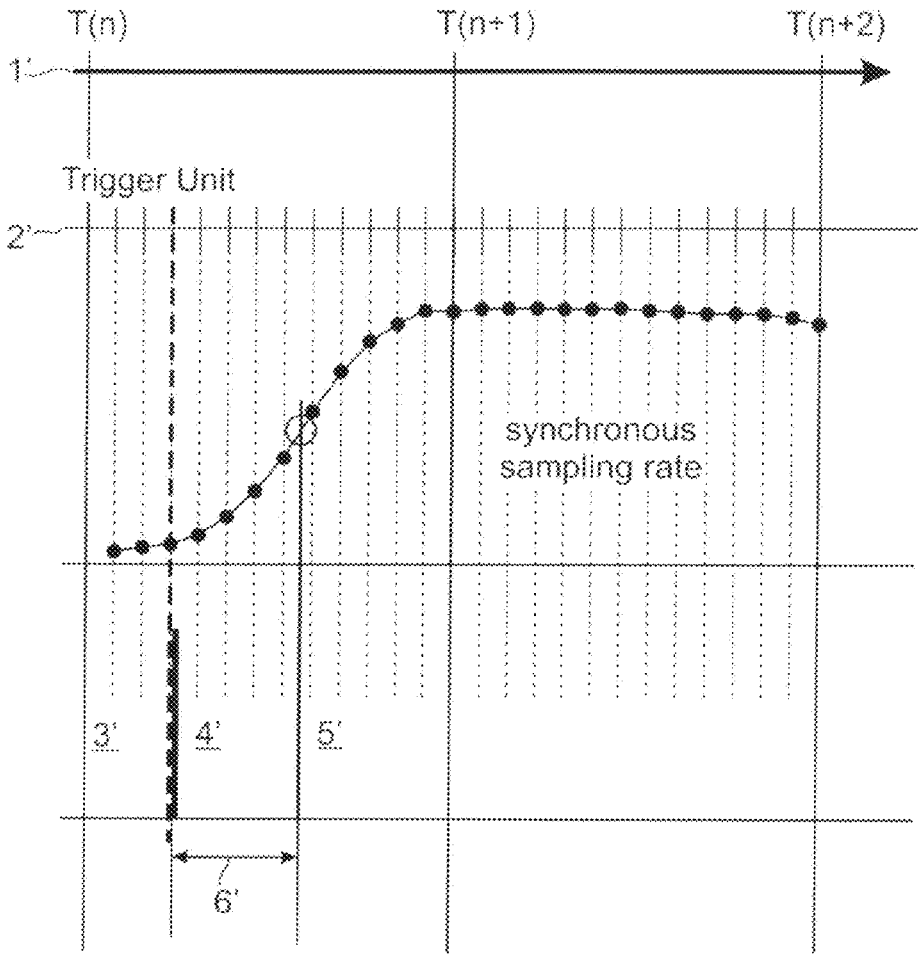
FIG. 2 is a graph illustrating the determination of the register deviation.

Since all bus members in a real-time bus system are chronologically synchronized with each other, the transmission of any of this information is performed very exactly in a common time context. It is particularly preferred that a further refined partition is generated in the trigger unit 4 or 8. This partition is, however, always synchronous with respect to the time context of the bus 12 and supplies a high precision time resolution between the aforementioned reference data (time stamps) (see FIG. 2. which is a graph illustrating the determination of the register deviation). Based on the known position information, which, for example, originate from the printing cylinder, and the associated time information, a future point of time is calculated, at which a measuring step is triggered by a trigger signal. The point of time of the trigger signal is preferably as near as possible to the last reference date, such that the assignment of positions to a measuring object at a predetermined location is performed as precisely as possible. The trigger signal is either used directly for triggering the measuring step, or the pre-calculated trigger time is transmitted to the measuring system via the bus system. In this way, each measurement is always performed very exactly at the same location of the printed web and/or very exactly at a predetermined rotational angle position of the plate cylinder of a printing press. This way of operation results in high precision when determining the position of an image printed by a printing unit, in particular when using a web-cylinder-method.

The measuring system may include, for example, a reflection web scanner or transmitted light web scanner of common design or a surface camera can be used for starting a measuring step through a start signal generated therewith. As a first example, the use of printed marks and a scanning by means of an optical measuring head, below which the printed marks pass, shall be described.

The optical reflection scanner head records a gradient of brightness and evaluates (see e.g. EP 0 637 286) the detected signals as position information, by, for example, detecting the edges of printed marks and converting same—when knowing the size and shape thereof (and possibly also their order)—into position information of the individual printed marks. The correct assignment of the time response of the electric signal and the position of the printed web is important for precision. For this purpose, a velocity-dependent scanning rate for the digitalisation of the brightness gradient is derived from the existing position information and time information. In this way, the complete recordal is performed virtually independent of the velocity and effects the measuring accuracy required for the object, due to a high precision, constant number of measuring points per distance.

For this purpose, the measuring data are stored together with associated time stamps. Rotational angle position information and time stamps are synchronously stored. The digitalized progress signal is evaluated as usual (e.g. the edges are detected). The data measured in the progress signal concerning the position of the printed marks are then converted into a real metric position by means of the stored position information and time stamps. The bus cycle time and deviations due to the bus topology no longer have an influence on the measuring result, such that the precision and reproducibility of the measurement is considerably increased compared to previous methods using an independently generated scanning rate.

The calculated result of the position measurement is transmitted to the register control unit 3 or 7 through the real-time bus 12. In this sense, it may also be advantageous to transmit only deviations of measured values from a target position known per se.

The register control unit 3 or 7 calculates a correction command for the drive controller based on the position data or position deviation data by using a control algorithm and possibly by adding data from other sources and transmits same through the same bus 12 to one or more drive controller(s) 9 or 10.

In case a surface camera or a comparable image-recording sensor is used in the measuring head 1 or 5, the process occurs analogously to the aforementioned method, with the exception that an image evaluation replaces the edge detection method, which image evaluation utilizes a different method for determining the position of the object printed mark (herein mostly in a small point shape), e.g. an object isolation and/or center determination. The described digitalisation of an analog sequence by using a high precision sampling rate is omitted in this case.

A basic problem when using a matrix camera is that the image field size and the resolution depend on each other. The wedge-shaped printed marks, which are arranged with a relatively large distance to one another, would require such a large image field when simultaneously recording all marks by means of one single photo, that the resolution of the taken picture, when using common cameras, would no longer be sufficient to measure the marks with sufficient accuracy. A combination of a plurality of images obtained from successive printouts into a complete image of all printed marks has several disadvantages. On the one hand, too much running meters of material in the printing press are required and, on the other hand, the partial images originate from different situations. For the purpose of controlling the register in a gravure printing press, it is very disadvantageous if the time intervals between two measurements (e.g. over a plurality of successive specimen) become relatively large, since these machines normally show a very dynamic register behavior, in particular when processing foils and films.

However, since the use of point-shaped marks has the advantage of saving material and also features a higher precision of the measured data, and since on the other hand many cylinders including wedge-shaped marks are still in use and can be changed only with high costs, a solution is worthwhile which includes and evaluates all position information in one single coherent image, such that wedge-shaped and point-shaped marks can be processed by one and the same register controller. Therefore, another embodiment of the proposed invention, which eliminates the aforementioned deficiency will be described below.

This embodiment uses an image-recording sensor system which uses a line-by-line photo of an image, wherein one axis is formed by the sensor line direction and the other axis is stretched by the motion of the web.

A line camera is used to take the photo, which records image lines from a web passing below the camera in a fixed, very precisely defined and controlled order. These image lines are then combined into an image, the extension of which in the running direction X of the web represents the time and transversely represents the axis Y of the path.

By using a real-time bus system and generating a further refined time partition, the register control system has a cycle sequence with high precision synchronization and high resolution at all measuring points, being associated with the means of transportation of the web and thus location-dependent. The cycle sequence is generated from the time axis. Preferably, time information from the drive bus of the printing press is used for generating such time axis, such that a high precision relationship with respect to the motion of the printed web is guaranteed.

Figure 5:
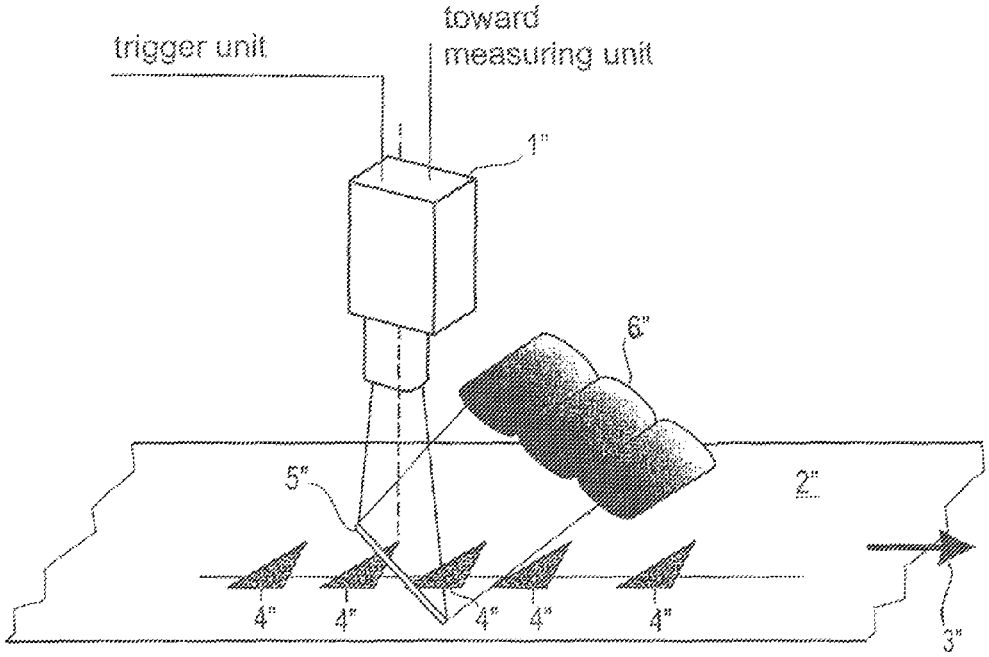
FIG. 5 is a schematic illustration of another embodiment of a register control device which in this case uses a line camera.

As best shown in FIG. 5, the recording device includes a line camera 1" which consists of a sensor having a plurality of sensor elements arranged side-by-side in lines (e.g. a CCD line with at least 500 elements) and a lighting device 6", a recording controller effected by the trigger unit 4 (FIG. 1), an image processing unit, which is realized in the measuring unit 2 of FIG. 1, and a bus interface, which in the present example is the real-time bus system 12.

The complete apparatus is configured such that it is capable to operate in different operation modes, which differ from each other substantially by different scanning modes and evaluation modes. In the most simple embodiment, the trigger unit, the measuring unit and other components affected by the switching are accordingly initialised by a superordinate central unit.

Figure 3:
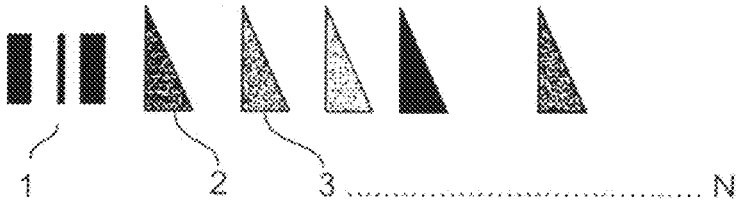
FIG. 3 illustrates one example for a measuring mark field.
Figure 4:
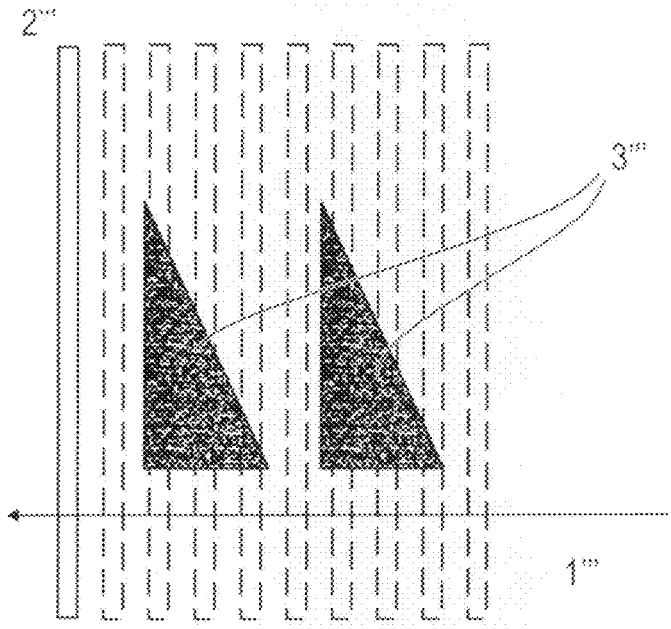
FIG. 4 is a schematic illustration of a recording line with printed marks arranged along the running direction of the web.

The camera operates in accordance with the type and size of the marks to be measured, with different line recording regimes for generating a complete image (see FIG. 3. which is illustrates one example for a measuring mark field). When scanning wedge-shaped marks, which may have a substantially larger extension in particular in the running direction of the web (X direction) and also generally cover a larger printed surface, a scanning mode can be chosen which generates a complete image which is allowed to have omissions (see FIG. 4, which is a schematic illustration of a recording line with printed marks arranged along the running direction of the web). Based on the prior knowledge of the geometry of the marks, omissions in the image can be skipped during the evaluation in a simple manner. This approach provides that the amount of image information is as small as possible and, in particular, redundant or irrelevant information, such as parts of the image not to be considered for the register measurement, are prevented to a large extent.

In one embodiment of the method of the present invention, the sensor line of the line camera is arranged in an angle with respect to the running direction of the web. Preferably this angle is not 90° (e.g. 45°). Recording and evaluation are performed as already described, in different modes depending on the shape of the mark (e.g. wedge-shaped or point-shaped).

In case of a field with triangular marks having a size of several millimeters edge length per mark and an adapted line resolution, a mark of 5 mm width requires less line images for being measured with sufficient accuracy. In this way, all successive marks can be arranged with one line into a continuous image and then measured, which originates from one and the same printed format part.

The evaluation uses edge detection algorithms including, for example, a turning point detection along an edge transition, wherein the turning point is then localized as the edge. In this case, an arrangement of the line at an angle not equal to 90° relative to the running direction of the web is advantageous, since an enhanced resolution can be obtained for edges positioned perpendicularly to the running direction.

In case a point-shaped pattern is used, the recordal is switched to a mode which records an allover image of the pattern. The evaluation is performed as would have been with an image taken by a matrix camera, since a complete image is generated in this mode, which comes close to that of a matrix camera and can also be evaluated accordingly. For example, an object search for point-shaped image objects of known size and subsequent center determination is performed in this context, wherein the centers are considered to be representative for the position of the printed marks.

For illumination purposes, it is preferred to use a flashlight source, for example, a line-shaped LED arrangement. Contrary to a continuous lighting, such a light source generates less heat in its environment. With such a light source, the possibility to generate an illumination spectrum, with a suitable spectral mixture of the emitting elements, which generates a maximum contrast with respect to the printed image parts to be scanned, has proven to be advantageous.

The aforementioned example of a line camera is not necessarily dependent on the aforementioned real-time bus. Its use only features one embodiment providing a high measuring accuracy. Basically, it may be sufficient for suitable applications to generate a sufficiently exact resolvent sequence of pulses, for example, by means of a pulse multiplication, which in turn is synchronized with a printing cylinder. In this case, it may be preferred to co-print a geometrically known pattern (e.g. two known, spaced marks), on the basis of which a geometric size for the recorded image can be calculated.

Dependent on the number and size of the marks used, this procedure also enables to record, measure and use patterns with different geometric shapes of the individual marks with one and the same device within a mark field for regulating the register.

With the described method according to the invention, it is thus possible to provide a register control system which achieves a very high accuracy, generates measuring data independent of the velocity, may very well cope with high dynamic changes of register deviations, is able to get along with a minimum effort for wiring and can be operated very flexible.

Simultaneously, the system operated according to the invention enables a control to be completely decentralized or centralized. In the latter case, a control unit assumes all steps for determining the register control variables. The reading of measured data, the regulating of measuring and trigger units and the transmission of the correction values to the drive units are performed by the real-time bus.

Finally, a suitable embodiment of the proposed solution enables the measurement of wedge-shaped and point-shaped marks with the same register adjuster. With the above description in mind, the following list of reference numerals and their associated components are provided as a means of enabling the reader to quickly reference the drawings:

1, 5 measuring head
2, 6 measuring unit
3, 7 register regulating unit/register control unit
4, 8 trigger unit
9, 10 drive controller
11 virtual guide axis
12 bus system
13, 14 printing cylinder
15 central unit
16 web/material web/bore/printed fabric
DWn−1 to DWn+2 printing units
1' time stamp / reference date (real-time bus)
Tn, T(n+1, . . . )
2' synchronous partition
3' triggering of measuring step
4' target value measuring marks
5' measured actual value of register mark
6' register deviation
1" line camera
2" printed web
3" running direction of web
4" printed marks
5" recording line
6" illumination
1''' running direction of web
2''' recording line
3''' printed mark The present invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A method for controlling a register in a rotary printing press (18) by a register control device (17), wherein the printing press (18) includes at least two printing units (DWn-1 to DWn+2), each of which includes at least one cylinder (13) supporting a printing image to be transmitted and at least one cylinder (14) pressing a print fabric (16) against the other cylinder, and the control device (17) comprising at least a measuring unit (2, 6) and a measuring head (1, 5), a register control unit (3. 7), a trigger unit (4, 8) and a drive unit (9, 10), wherein components (2, 6; 1, 5; 3, 7; 4, 8; 9, 10) of the control device (17) are mutually connected through a real-time bus system (12) in which all bus members of the real-time bus system (12) are chronologically synchronized with each other, the method comprising the steps of:

a. for each trigger unit and/or measuring unit and/or register control unit, a reference time signal is generated and transmitted via the bus system (12), which refers to a time reference common to all components, which is generated by the bus system (12), b. a time interval limited by at least 2 reference time signals issued chronologically in succession is further divided by the trigger unit by issuing at least one time signal located between the reference dates, c. the trigger unit selects one signal from the signal sequence generated in the preceding step for triggering a measuring step to be performed by the measuring head.

d. the measuring head detects a printed pattern which is part of the printed printout, and e. in the measuring unit, position information concerning the printout respectively transmitted by the printing unit is determined based on the pattern scanned by the measuring head, f. in the register control unit, correction values are calculated based on the position information determined by one or more measuring unit(s), and g. the correction values are transmitted to the drive units for operation thereof.

2. The method of claim 1, wherein the measuring unit transmits the position information via the real-time bus system.

3. The method of claim 1, wherein the correction values determined by the measuring unit are transmitted via the real-time bus system to the drive units.

4. The method of claim 1, wherein the measuring head is an optical scanning head which records and digitalizes by at least one light spot via a remission curve generated by a passing mark arrangement, wherein a sampling rate for the digitalisation in the measuring unit is formed synchronously with the reference data generated.

5. The method of claim 1, wherein the measuring head includes a two-dimensional image sensor and performs the image recordal which is triggered by the trigger unit.

6. The method of claim 1, wherein a trigger unit generates the data for a plurality of measuring units.

7. The method of claim 1, wherein a register control unit determines register correction values for a plurality of printing units.

8. The method of claim 1, wherein the transmission of the position information and/or the register correction values and/or the trigger information is performed via the real-time bus system.

9. The method of claim 1, wherein a measuring unit determines position information concerning a plurality of printouts printed by different printing units.

10. The method of claim 1, wherein the measuring head is formed as an image-recording sensor, a. which records images with a lateral relationship having a multiple value perpendicular to the running direction of the web compared to its value in the running direction, b. wherein the recordal of an image is driven such that an image is recorded upon each triggering, c. the triggering is performed such that a plurality of such images is recorded on one print format, wherein the distance between two images can be adjusted individually, d. this individual adjustment is predefined for the trigger unit and/or the measuring unit as an operation mode by a central unit (11), e. a plurality of such images can be combined into an evaluation frame, f. the evaluation of the evaluation frame for measuring the register deviations is performed in accordance with the operation mode.

11. The method of claim 10, wherein at least one operation mode generates an image.

12. The method of claim 11, wherein, in one mode, a measuring of a mark field consisting of point-shaped marks is performed and, in a second mode, a field consisting of wedge-shaped marks is measured.

13. The method of claim 10, wherein the image-recording sensor is a line camera.

14. The method of claim 13 wherein the line camera is aligned such that the sensor line is inclined with respect to the running direction of the web by an angle which differs from 90°.

15. The method of claim 14, wherein the line camera is arranged rotatably about its optical axis and can be rotated in a controlled manner by an adjusting device.

* * * * *